US006818075B1

(12) United States Patent
Park et al.

(10) Patent No.: US 6,818,075 B1
(45) Date of Patent: Nov. 16, 2004

(54) NON-COMBUSTIBLE MAGNESIUM ALLOY

(75) Inventors: Won Wook Park, Kyungnam (KR); Bong Sun You, Kyungnam (KR); Moon Hoe Kim, Seoul (KR)

(73) Assignee: Korea Institute of Machinery and Materials, Kyungnam (KR)

( * ) Notice: Subject to any disclaimer, the term of this patent is extended or adjusted under 35 U.S.C. 154(b) by 259 days.

(21) Appl. No.: 09/694,717

(22) Filed: Oct. 23, 2000

(30) Foreign Application Priority Data

Oct. 22, 1999 (KR) ..... 99-45954

(51) Int. Cl.[7] ..... C22C 23/00

(52) U.S. Cl. ..... 148/420; 148/275; 420/402; 420/405; 420/407

(58) Field of Search ..... 420/402, 405, 420/407; 148/420, 275

(56) References Cited

U.S. PATENT DOCUMENTS 5,078,962 A * 1/1992 Regazzoni et al. ..... 420/402

OTHER PUBLICATIONS

RN: 12634–54–7 Registry from Chemical Abstract.*
RN: 51809–13–3 Registry from Chemical Abstract.*

* cited by examiner

*Primary Examiner*—Sikyin Ip
(74) *Attorney, Agent, or Firm*—Thompson Coburn, LLP

(57) ABSTRACT

The present invention relates to a non-combustible magnesium alloy, comprising one of elements of Al at 0.1~3 wt %, La at 0.1~3 wt %, Nd at 0.1~3 wt %, or Y at 0.005~3 wt %; 0.5~10 wt % of Ca; and the remainder of conventional magnesium alloy. Alternatively, the present invention entails a non-combustible magnesium alloy comprising 0.005~4 wt % of multiple additives of two or more types of elements selected from the group consisting of Al, La, Nd and Y; 0.5~10 wt % of Ca; and the remainder of conventional magnesium alloy. The magnesium alloy of the present invention has high oxidation-resistance, which translates into high manufacturability in air or in the generally non-oxidative atmosphere ($SO_2$, Ar, $CO_2$, $N_2$). Moreover, in cases of manufacturing various components by re-melting the above alloys, it is possible to melt and cast the same in a certain period of time within the bounds of not breaking the dross layer in air or in the generally non-oxidative atmosphere ($SO_2$, Ar, $CO_2$, $N_2$). In addition, due to the superior pyrophoric characteristics, spontaneous combustion of the chips accumulated during the mechanical processing can be effectively prevented. Further, the present invention, by not using certain types of gas such as $SF_6$, brings about beneficial collateral effects of cost reduction, protection of workers' health, prevention of environmental pollution, etc.

14 Claims, 10 Drawing Sheets

NON-COMBUSTIBLE MAGNESIUM ALLOY

TECHNICAL FIELD

The present invention relates to a non-combustible magnesium alloy having enhanced pyrophoric characteristics and oxidation-resistance.

BACKGROUND OF THE INVENTION

Up to now, in products for automobiles, such as a cylinder head-cover, oil pan, disc wheel, and transmission case, aluminum alloys with low specific gravity have been extensively used in Korea and abroad.

As a material for further imparting the quality of being light weight, magnesium (density of approximately 1.74 g/cm$^3$) or magnesium alloy, having lower specific gravity than aluminum, has received the spotlight in recent years and is currently being widely used for materials for aircrafts, automobiles, portable machineries, and other daily-used products. In this light, there seems to be a trend of expanding the range of its applications.

In electrochemical terms, however, magnesium has lower electrical potential and is a very reactive metal, which is highly corrosive by means of air, water, and other chemicals it contacts. Furthermore, magnesium has a melting point of 659° C., which is similar to that of aluminum, but has a higher vapor pressure and stronger oxidation tendencies, which in turn leads to spontaneous combustion at the temperature of 850° C. or higher due to its volatilization. Moreover, unlike aluminum, the MgO layer formed on the surface of the molten metal is not dense, but instead it forms a thick oxidation layer, which in turn leads to defects in casting materials and loss of molten metals. As such, it must be melted in a protective atmosphere by means of using flux and/or inert mixed gas such as $CO_2$+Air+$SF_6$.

However, the above-mentioned flux used during melting and smelting is chloride-based. Hence, in the case of using said flux to prevent oxidation and combustion, there is a problem of significantly lowering the corrosion-resistance of the material by residual chlorides if the processing condition is incomplete.

In order to resolve such disadvantages, rather than using the aforementioned flux, there is a method of melting and casting the same in the atmosphere of mixture of $SF_6$, $CO_2$, and air. The amount of $SF_6$ gas used in order to prevent oxidation in the above method is 0.05% during the stationary state of the molten metal, and depending on the temperature during stirring, 0.01% at 700° C., or 1% at the temperature above 700° C. The mixed gas used at this point of the process has the effect of changing the characteristics of the Mg oxidation layer while suppressing the continual oxidation and volatilization of the molten metal. Hence, the above mixed gas is currently being used in most of the manufacturing processes. However, approximately 5~7 tons of $CO_2$, and 0.5 kg of $SF_6$ gas are necessary to produce 1 ton of magnesium. Then, to cast the magnesium alloy, 1 kg of $SF_6$ gas is needed per 1 ton of magnesium. Moreover, $CO_2$ and $SF_6$ gases are major causes of the phenomenon of global warming. Compared to $CO_2$ gas, the harmful effects of $SF_6$ on global warming are substantially more serious. Based on research findings, 1 kg of $SF_6$ has the same effect of global warming as approximately 24 tons of $CO_2$ gas. The resulting effect of producing 1 ton of magnesium is as if approximately 50 tons of $CO_2$ gas was being used. Hence, the destructive effect on global environment, caused by using the mixed gas, is of an enormous scale. Consequently, it is expected that the manufacturing processes of magnesium alloys by means of using the mixed gas will be subject to government regulations in the near future. Moreover, the method of using the mixed gas as above entails the following sets of serious problems: rising costs attributable to the removal of the dross and the usage of the $SF_6$ gas; the burden of environment costs with respect to air pollution; deterioration of workers' health due to the discharge of toxic gas; deterioration of safety during the mechanical operations (i.e., cutting) due to the extremely low temperature (500° C.) of the point of spontaneous combustion, etc.

SUMMARY OF THE INVENTION

The objectives of the present invention lie in providing a non-combustible magnesium alloy, which can be used as materials for a wide variety of components, having enhanced oxidation-resistance for melting of the same in air or in the generally non-oxidative atmosphere ($SO_2$, Ar, $CO_2$, $N_2$), and improved pyrophoric characteristics for preventing spontaneous combustion of chips accumulated after the mechanical processing of the components. Further, because it can be melted and casted in an environment that does not include $SF_6$, the present invention brings about beneficial collateral effects of cost reduction, protection of workers' health, and prevention of environmental pollution, etc.

DETAILED DESCRIPTION OF THE PREFERRED EMBODIMENT

Figure 1:
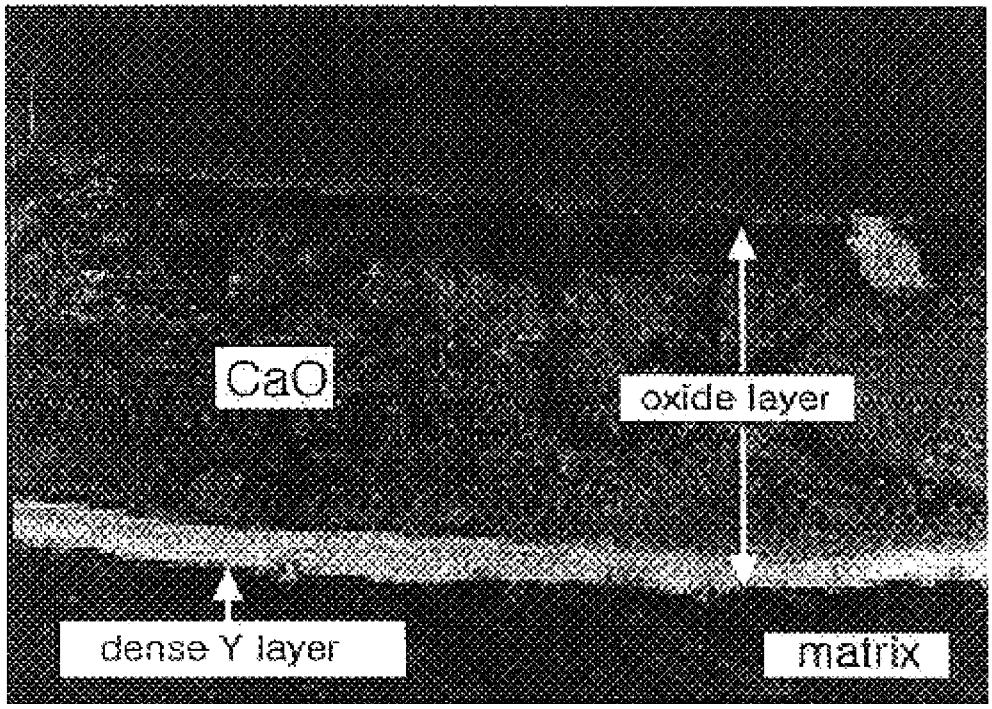
FIG. 1 is a microstructure of the magnesium alloy of the present invention.

In order to design a magnesium alloy which can be melted in air or in the generally non-oxidative atmosphere ($SO_2$, Ar, $CO_2$, $N_2$), the process should be controlled in such a way to ensure the tightness of the internal structure of the dross during melting and structure of the alloy surface layer after solidification. Up to now, it has been known that if Ca is added to Mg, the internal structure of the molten-metal dross becomes compact and tight, in addition to forming a dense structure of CaO and CaO+MgO on the surface of the alloy after solidification. Consequently, the basic concept of the alloys of the present invention lies in discovering an element which can form a stable surface layer with a higher oxidation property than that of Mg (other than Ca) or in appropriately combining the alloy elements having superior non-combustibility in conjunction with the addition of Ca.

At this point in the process, the melting of the alloy which leads to non-combustibility should occur, in conjunction with forming a stable and tight dross layer during casting, so that the molten metal is not in contact with oxygen. To achieve these goals, the following factors should be pre-examined: the volume ratio between the molten metal and the oxides; growth direction of oxides; reactions and the role of various types of oxides, etc. In addition to the aforementioned factors, it should be considered whether the suppression effect of oxidation on the surface layer, in cases of solidified alloys, is in anyway related to the emergence of a non-equilibrium or precipitation phase, or to the expansion of the grains.

In consideration of these effects, the present invention provides a magnesium alloy, after imparting non-combustibility to the molten metal by adding 0.5~10 wt % of Ca to the magnesium or to the conventional magnesium alloy, wherein said alloy comprises one of elements of 0.1~3 wt % of Al, 0.1~3 wt % of La, 0.1~3 wt % of Nd, or 0.005~3 wt % of Y.

In addition to having enhanced pyrophoric characteristics and oxidation-resistance, the magnesium alloy of the present invention with the aforementioned composition allows melt-casting for a certain period of time, within the bounds of not breaking the dross layer, in air or in the generally non-oxidative atmosphere ($SO_2$, Ar, $CO_2$, $N_2$) In particular, because of the combustion of the magnesium-alloy chips formed during the mechanical processing (i.e., cutting) with violent oxidation reactions at the temperature of 500° C. or higher, extreme caution for safety is warranted during its processing. However, the combustion temperature thereof can be raised significantly since the oxidation resistance of the magnesium alloy of the present invention is rather high. Here, the combustion temperature rises because the trace amount of an added element (Al, La, Nd, Y) changes the characteristics of the oxidation layer of the magnesium alloy during the oxidation process of the alloy. In other words, the rise in combustion temperature is due to the fact that the oxides of the added elements are formed within the porous oxidation layer of Mg, and then the entire oxidation layer is changed into a tight protective layer.

Here, the amount of elements to be added should be more than a certain level for smooth working of the aforementioned changes. In the case of Al, La, or Nd, which is added as a ternary element in addition to Mg and Ca, the content amount thereof should be 0.1 wt % or more for changing the oxidation layer. In the case of Y, even an infinitesimal amount of 0.005 wt % or more can change the characteristics of the oxidation layer, which in turn induces the enhancement of oxidation resistance. However, if the amount of added elements is more than 3 wt %, the cost per unit of alloy is increased due to the increasing amount of high-priced elements added, even though the oxidation resistance in itself is enhanced. Further, as for the actual utilization of the alloy, it will significantly deviate from the desirable mechanical characteristics, which in turn results in the limitation of the applications thereof.

In addition to the method of adding only one type of ternary elements (Al, La, Nd, Y), two or more types of the same can be added, resulting in a greater effect of oxidation-resistance of the alloy. In these cases of multiple additions, if the added amount is more than 0.005 wt % in terms of the alloy containing Y, the same effect can be obtained, although more than 4.0 wt % is problematic in view of the associated costs and the changes in its characteristics.

The preferable embodiments of the present invention with references to the attached Figures are explained in detail as follows. The invention, not limited to pure magnesium as base material, may be applicable to the conventional magnesium alloy, such as AZ91 or AM60.

EXAMPLE 1

Using pure Mg (product of Norsk Hydro Co.), Mg-50%La, and Mg-50Nd base alloy, along with Al and Y, the process herein entailed the production of approximately 1.5 kg of ingots of binary and ternary alloys of Mg—2Ca, Mg—2Ca—2Al, Mg—2Ca—2Y, Mg—2Ca—La, and Mg—2Ca—Nd. From these ingots, test pieces of height of 20 mm, width of 20 mm, and length of 30 mm were prepared.

The magnesium alloy as mentioned above was placed in a steel pot with the inner diameter of 50 mm. Then, the experiment for melting-oxidation was carried out by placing the alloy, exposed to air, into a crucible and maintaining the same at 700° C. and at 750° C. for one hour, respectively. Subsequently, it was slowly cooled in the crucible, followed by air-cooling below the melting point.

The oxidation amounts were measured with the alloys still in place by means of differences in weight before and after the melting-oxidation experiment. As for the measurement of the weight, an electric scale with capability of measuring up to 1/1000 g was used.

Figure 2:
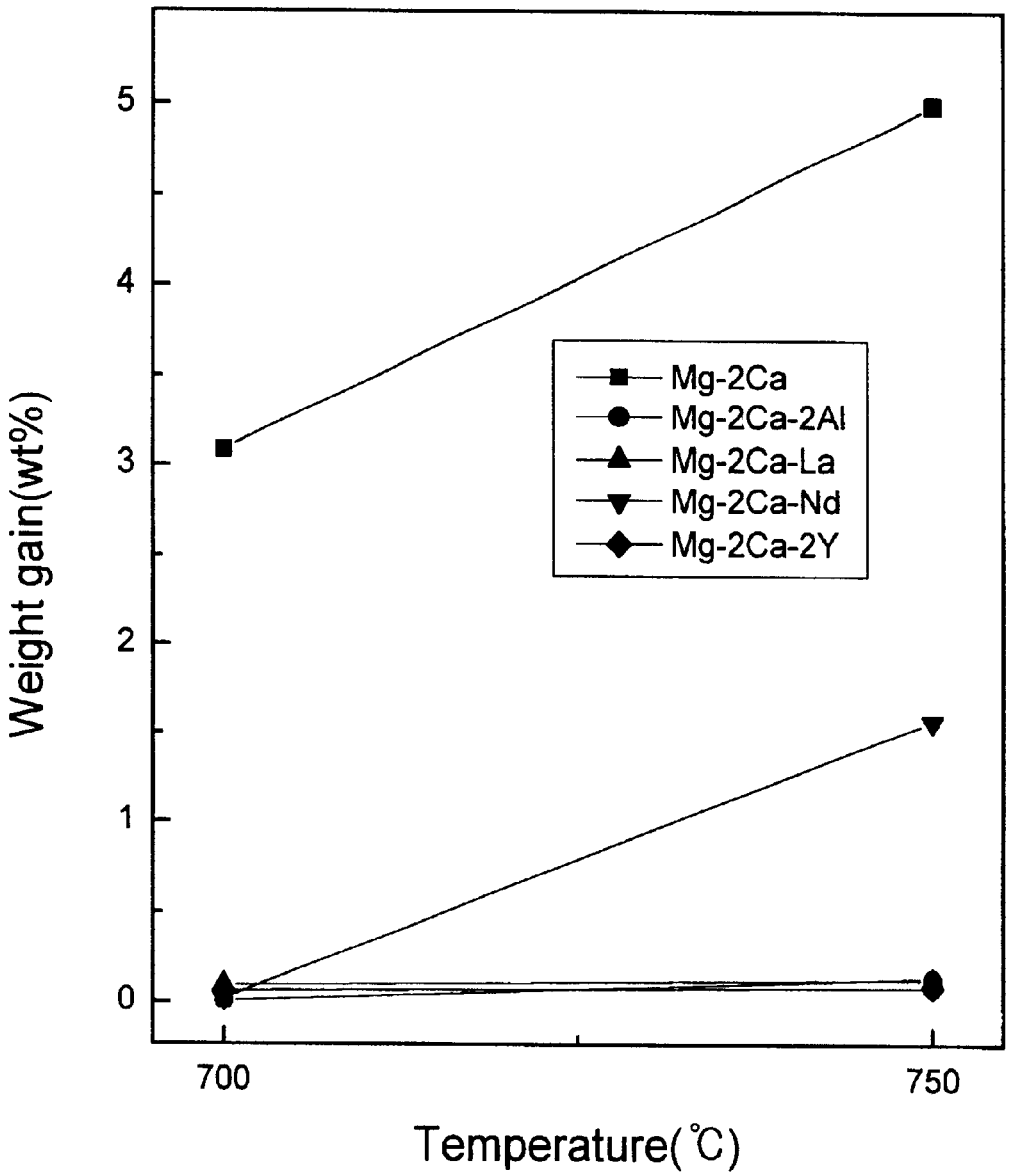
FIG. 2 is a line graph, which compares the increases in the amounts of oxidation of the magnesium alloys of the present invention with those of the comparative material of Example 1.

As recognized by the melting-oxidation experiment of FIG. 4, and the oxidation curve of FIG. 2, in comparing the comparative material (Mg—2Ca) with the materials of the present invention, it could be seen that the comparative material was in very poor condition because of the pyrophoric combustion caused by the growth of MgO through the oxidation layer. On the other hand, in most of the materials of the present invention, there was no pyrophoric combustion since the growth of MgO was thwarted by the formation of the tight CaO layer and the dense layer of La, Nd, and Y, respectively, immediately below said CaO layer (refer to FIG. 1).

Figure 5A:
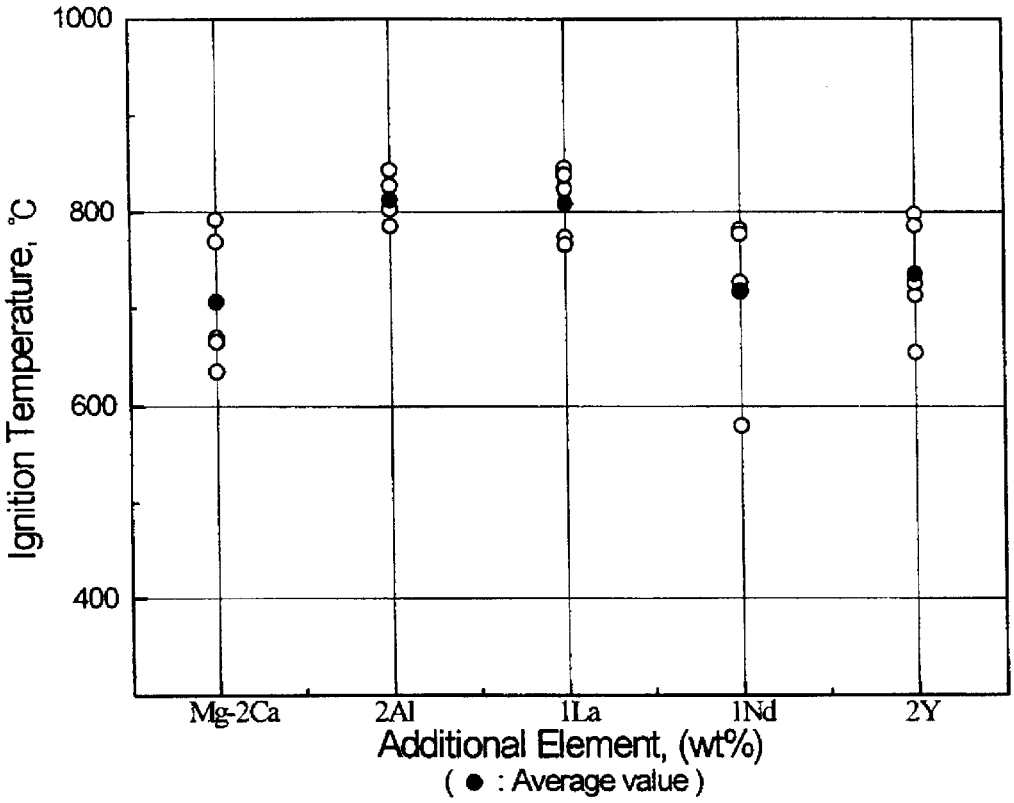
FIG. 5*a* is a line graph, which compares the ignition temperatures of chipped powders in the cases of added ternary elements of Example 1, respectively, to the binary Mg—Ca with the cases of no such elements.

Further, as shown in FIG. 5*a,* the combustion temperatures (average values are indicated by black points) of the Mg—2 wt. % Ca base alloy of the present invention are higher than those of the cases without added third elements. Hence, spontaneous combustion of the chips accumulated during the mechanical processing can be effectively prevented herein.

EXAMPLE 2

Approximately 1.7 kg of ingots of ternary alloys of Mg—2Ca—0.3X (Al, La, Nd, Y) were prepared by using the same method of Example 1. From these ingots, test pieces were prepared with thickness of 20 mm and the diameter of 48 mm using lathe.

The experiment and the measurement of the amounts of oxidation were carried out in the same method as those of Example 1.

Figure 3:
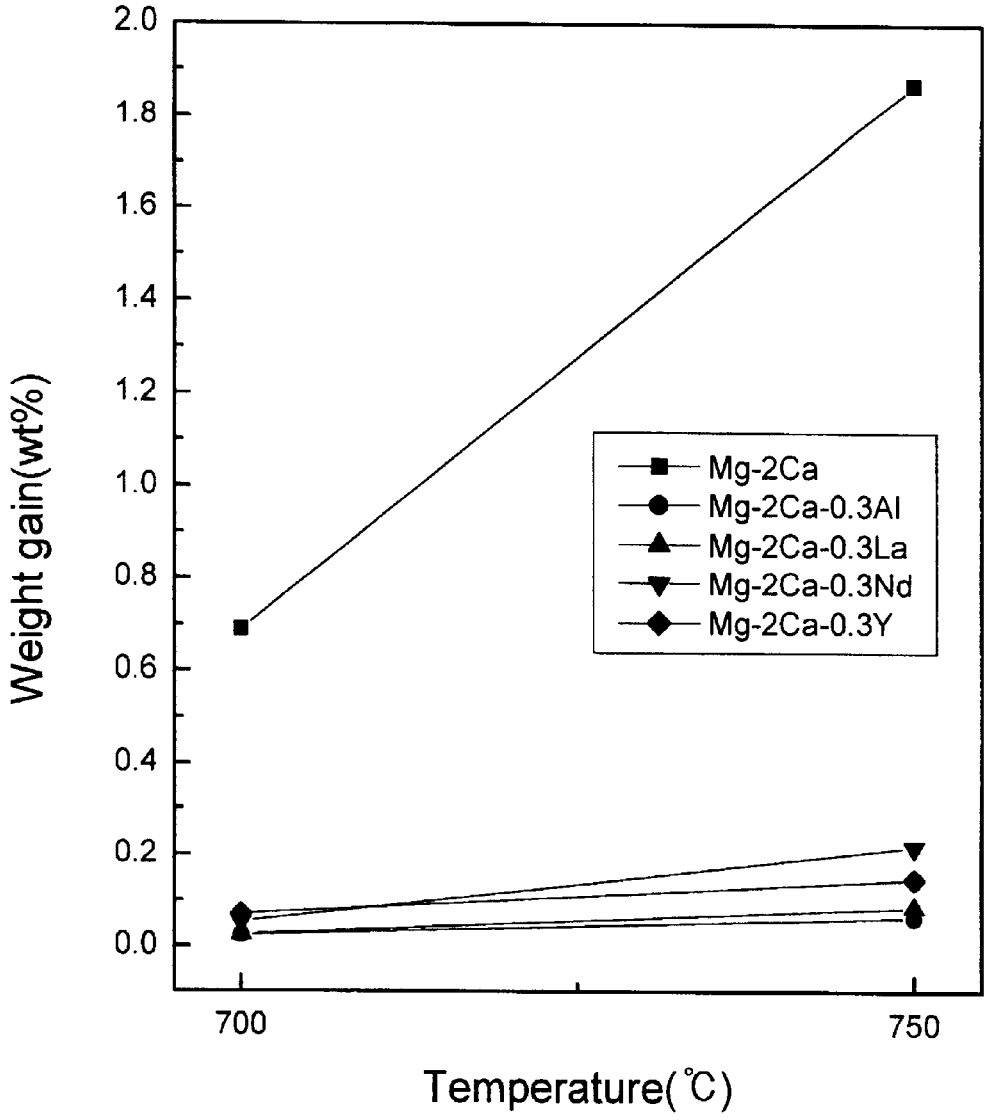
FIG. 3 is a line graph, which compares the increases in the amounts of oxidation of the magnesium alloys of the present invention with those of the comparative material of Example 2.
Figure 4A:
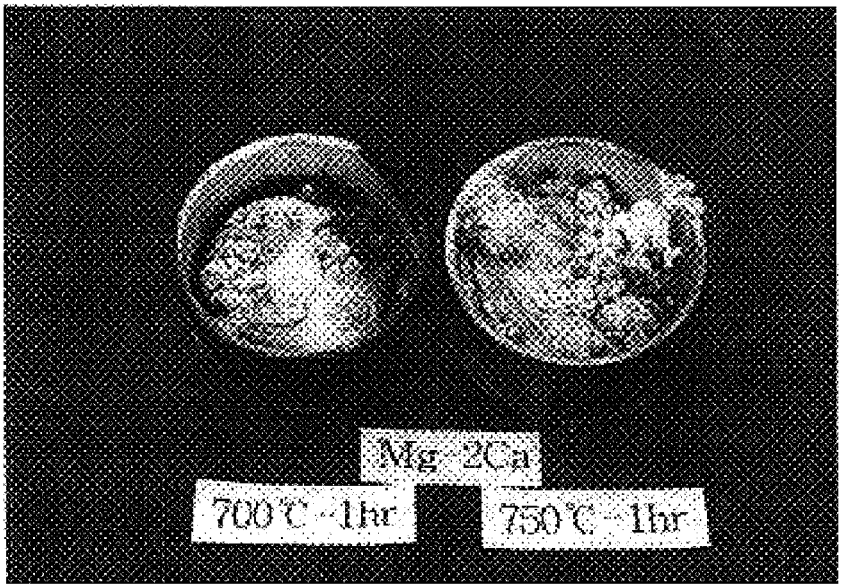
FIG. 4*a* is a photograph showing the external appearance of the magnesium alloy with an alone addition of conventional Ca, after melting and oxidizing the same in air.
Figure 4B:
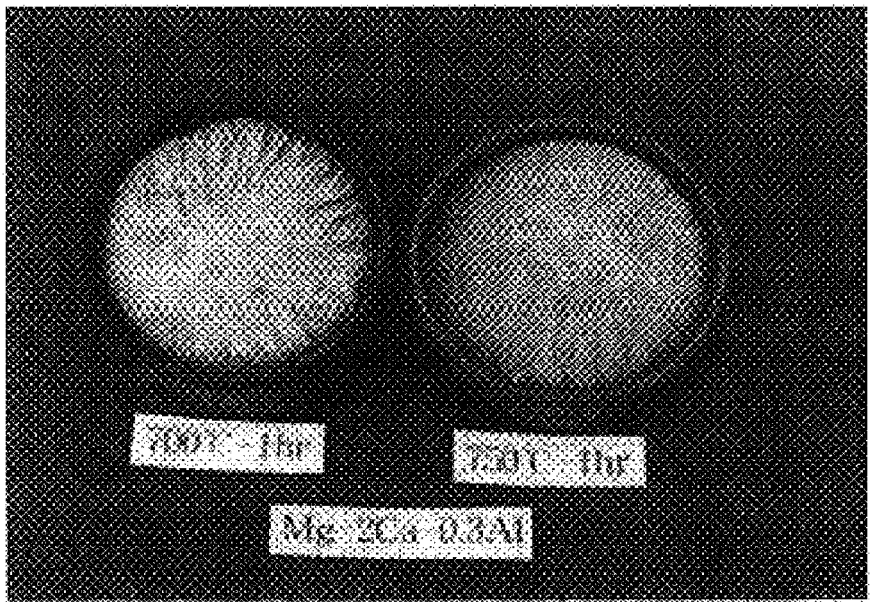
FIG. 4*b* is a photograph showing the external appearance of the Mg—2Ca—0.3Al alloy of the present invention, after melting and oxidizing the same in air.
Figure 4C:
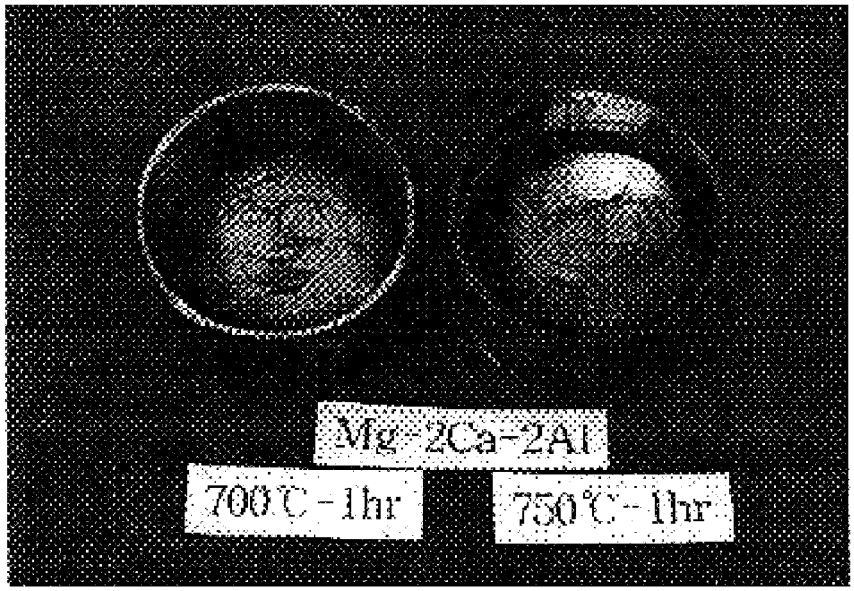
FIG. 4*c* is a photograph showing the external appearance of the Mg—2Ca—2Al alloy of the present invention, after melting and oxidizing the same in air.
Figure 4D:
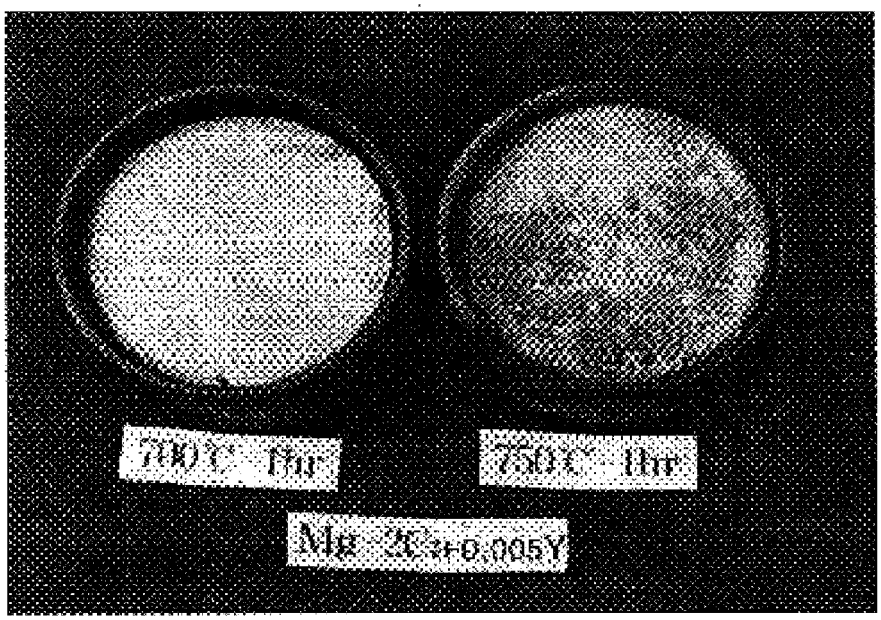
FIG. 4*d* is a photograph showing the external appearance of the Mg—2Ca—0.005Y alloy of the present invention, after melting and oxidizing the same in air.
Figure 4E:
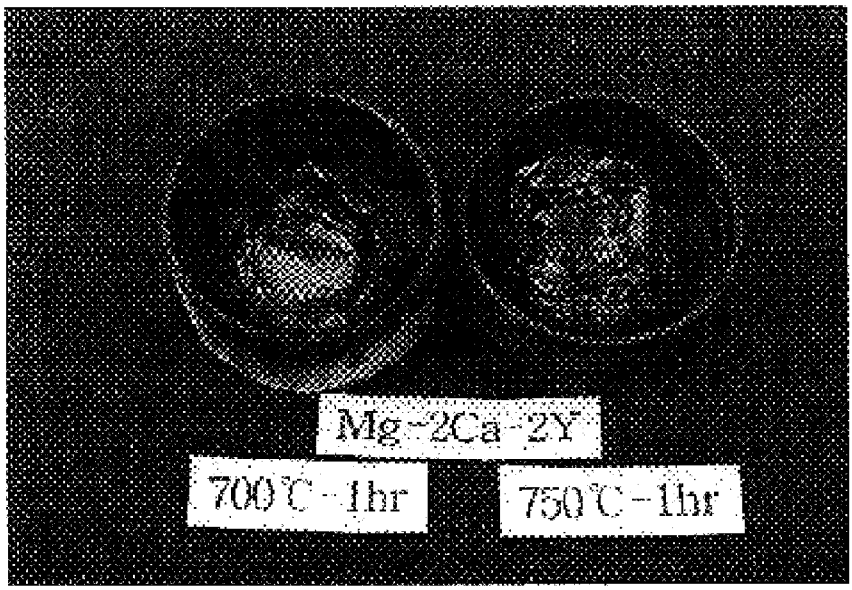
FIG. 4*e* is a photograph showing the external appearance of the Mg—2Ca—2Y alloy of the present invention, after melting and oxidizing the same in air.
Figure 4F:
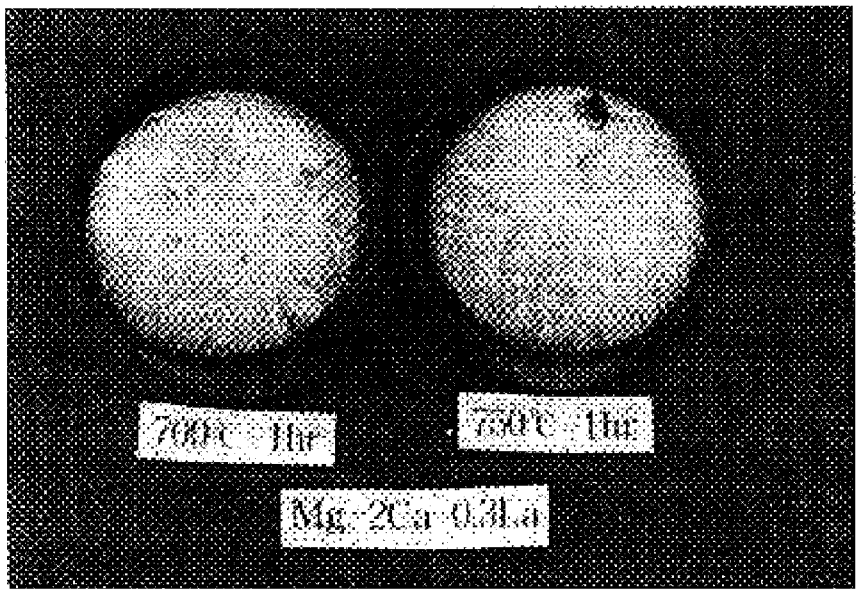
FIG. 4*f* is a photograph showing the external appearance of the Mg—2Ca—0.3La alloy of the present invention, after melting and oxidizing the same in air.
Figure 4G:
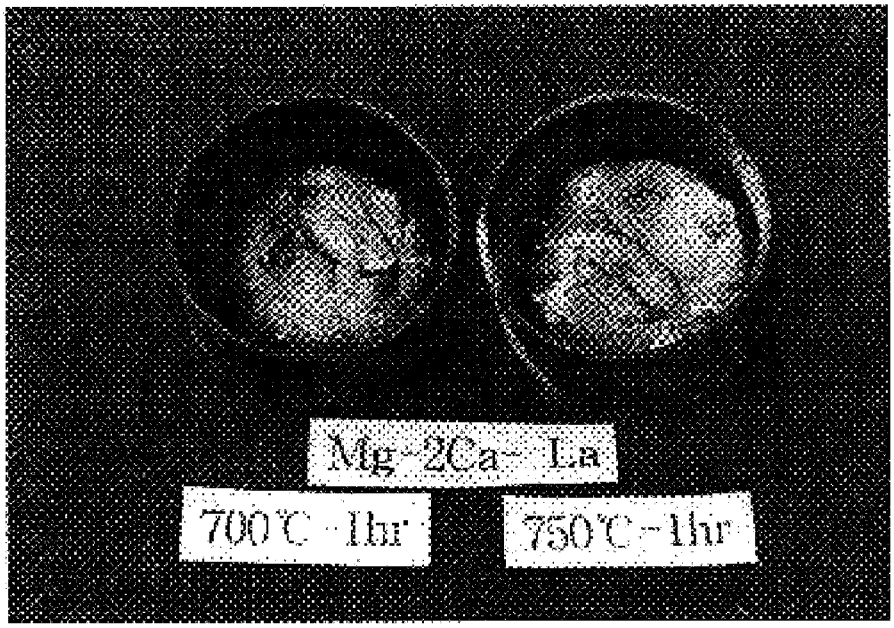
FIG. 4*g* is a photograph showing the external appearance of the Mg—2Ca—La alloy of the present invention, after melting and oxidizing the same in air.
Figure 4H:
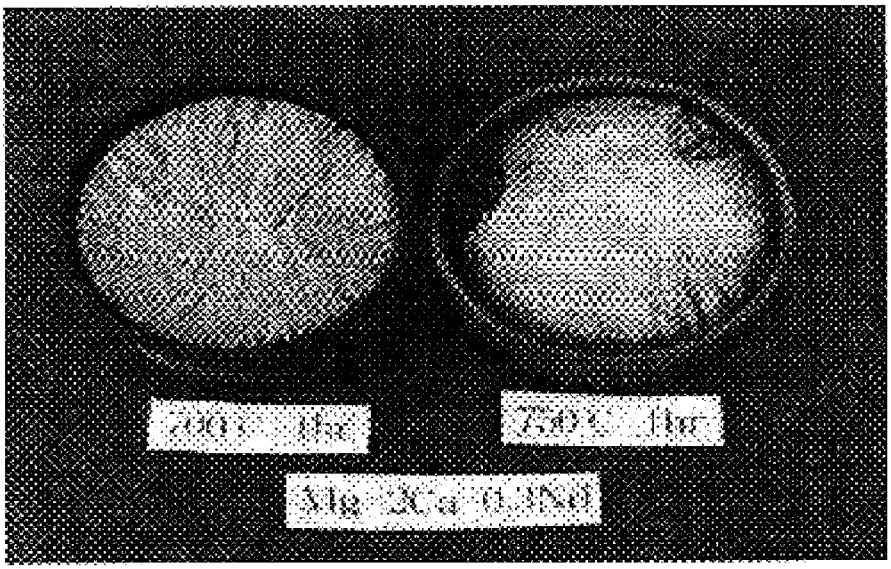
FIG. 4*h* is a photograph showing the external appearance of the Mg—2Ca—0.3Nd alloy of the present invention, after melting and oxidizing the same in air.
Figure 4I:
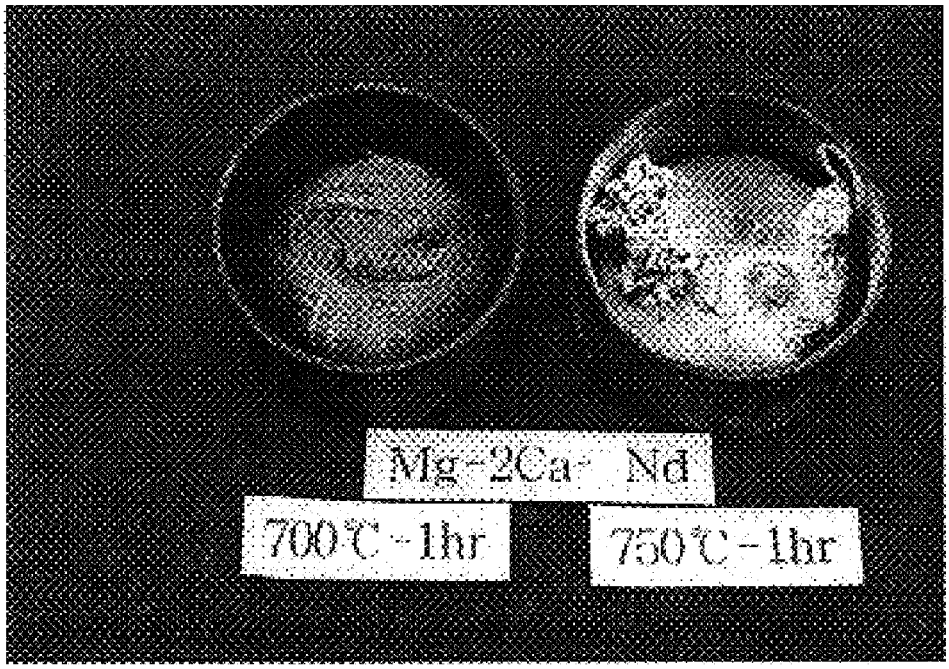
FIG. 4*i* is a photograph showing the external appearance of the Mg—2Ca—Nd alloy of the present invention, after melting and oxidizing the same in air.

As shown in FIGS. 1, 3, and 4, with respect to the materials of the present invention, the majority of them were in quite good condition due to the non-occurrence of pyrophoric combustion, which was attributable to fact that the growth of MgO was prevented by the formation of the tight oxidation layer.

Figure 5B:
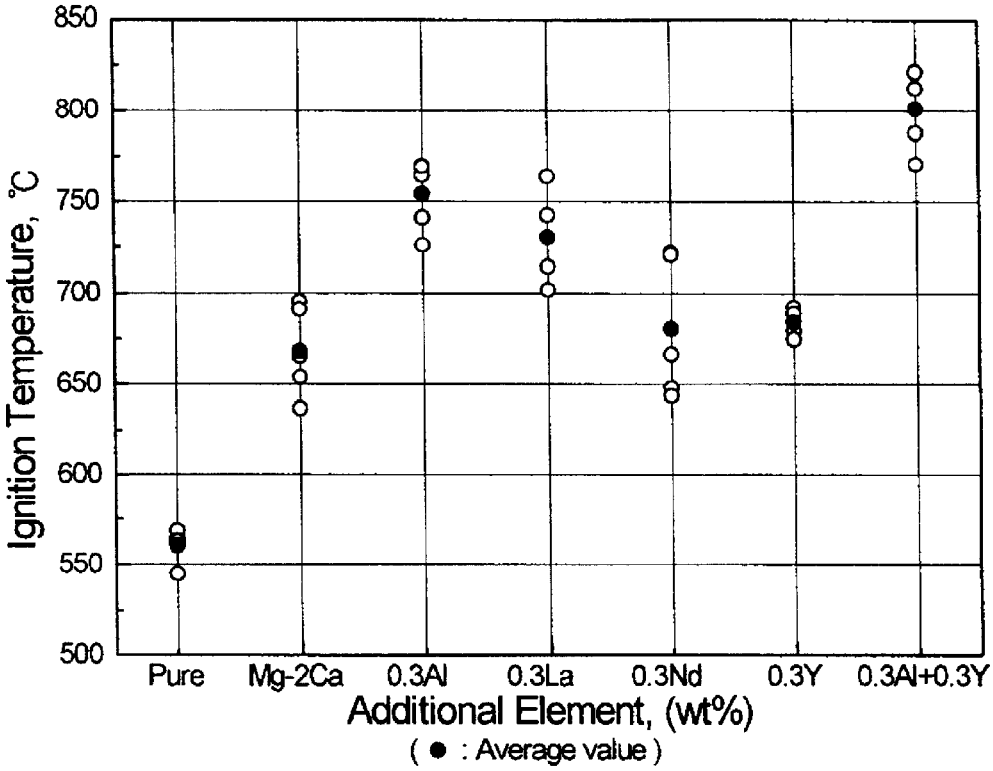
FIG. 5*b* is a line graph, which compares the ignition temperatures of chipped powders in the cases of added ternary elements of Example 2, respectively, to the binary Mg—Ca with the cases of no such elements.

Further, as shown in FIG. 5*b*, the combustion temperatures (average values are indicated by black points) of the Mg—2 wt. % Ca base alloy of the present invention are higher than those of the cases without added third elements. Hence, spontaneous combustion of the chips accumulated during the mechanical processing can be effectively prevented herein.

The magnesium alloy of the aforementioned composition has high oxidation-resistance, which translates into high manufacturability in air or in the generally non-oxidative atmosphere ($SO_2$, Ar, $CO_2$, $N_2$). Moreover, in cases of manufacturing various components by re-melting the above alloys, it is possible to melt and cast the same in a certain period of time within the bounds of not breaking the dross layer in air or in the generally non-oxidative atmosphere ($SO_2$, Ar, $CO_2$, $N_2$).

What is claimed is:

1. A non-combustible magnesium alloy comprising:

Ca at 0.5~10 wt %;

at least one selected from the group consisting of (a) element Al at 0.1~3 wt %, (b) element La at 0.1~3 wt %, (c) element Nd at 0.1~3 wt %, and (4) element Y at 0.005~3 wt %, wherein at least one of said at least one element selected from said group is Al, La, or Nd; and the balance being magnesium and impurities;

said non-combustible magnesium alloy having a magnesium alloy matrix and an oxide layer on the surface of said magnesium alloy matrix, said oxide layer containing a Ca oxide and an oxide of said at least one element Al, La, or Nd that is selected from said group.

2. A non-combustible magnesium alloy according to claim 1, wherein said non-combustible magnesium alloy further comprises at least two selected from said group, said at least two being selected from said group such that the combined wt % of said at least two elements is at most 4 wt %.

3. A non-combustible magnesium alloy according to claim 1, wherein said conventional magnesium alloy is AZ91 or AM60.

4. A non-combustible magnesium alloy according to claim 2, wherein said conventional magnesium alloy is AZ91 or AM60.

5. A non-combustible magnesium alloy according to claim 1 wherein at least two of said group are selected, wherein one of said at least two elements selected from said group is Y, said oxide layer further containing a Y oxide layer on a lower part of said oxide layer.

6. A non-combustible magnesium alloy according to claim 2 wherein one of said at least two elements selected from said group is Y, said oxide layer further containing a Y oxide layer on a lower part of said oxide layer.

7. A non-combustible magnesium alloy comprising:

Ca at 0.5~10 wt %;

at least one selected from the group consisting of (a) element Al at 0.1~3 wt %, (b) element La at 0.1~3 wt %, (c) element Nd at 0.1~3 wt %, and (4) element Y at 0.005~3 wt %, wherein at least one of said at least one element selected from said group is Al, La, or Nd; and the balance being a conventional magnesium alloy;

said non-combustible magnesium alloy having a magnesium alloy matrix and an oxide layer on the surface of said magnesium alloy matrix, said oxide layer containing a Ca oxide and an oxide of said at least one element Al, La, or Nd that is selected from said group.

8. A non-combustible magnesium alloy according to claim 7 wherein at least two of said group are selected, wherein one of said at least two elements selected from said group is Y, said oxide layer further containing a Y oxide layer on a lower part of said oxide layer.

9. A non-combustible magnesium alloy according to claim 3 wherein at least two of said group are selected, wherein one of said at least two elements selected from said group is Y, said oxide layer further containing a Y oxide layer on a lower part of said oxide layer.

10. A non-combustible magnesium alloy comprising:

a combined 0.005~4 wt % of at least two elements selected from the group consisting of Al, La, Nd, and Y, wherein at least one of the selected elements is Al, La, or Nd;

0.5~10 wt % of Ca; and the balance being a conventional magnesium alloy;

said non-combustible magnesium alloy having a magnesium alloy matrix and an oxide layer on the surface of said magnesium alloy matrix, said oxide layer containing a Ca oxide and an oxide of said at least one element Al, La, or Nd that is selected from said group.

11. A non-combustible magnesium alloy according to claim 10 wherein one of said at least two elements selected from said group is Y, said oxide layer further containing a Y oxide layer on a lower part of said oxide layer.

12. A non-combustible magnesium alloy according to claim 4 wherein one of said at least two elements selected from said group is Y, said oxide layer further containing a Y oxide layer on a lower part of said oxide layer.

13. A non-combustible magnesium alloy comprising:

a combined 0.005~4 wt % of at least two elements selected from the group consisting of Al, La, Nd, and Y, wherein at least one of the selected elements is Al, La, or Nd;

0.5~10 wt % of Ca; and the balance being magnesium and impurities;

said non-combustible magnesium alloy having a magnesium alloy matrix and an oxide layer on the surface of said magnesium alloy matrix, said oxide layer containing a Ca oxide and an oxide of said at least one element Al, La, or Nd that is selected from said group.

14. A non-combustible magnesium alloy according to claim 13 wherein one of said at least two elements selected from said group is Y, said oxide layer further containing a Y oxide layer on a lower part of said oxide layer.

* * * * *